US012078183B2

(12) United States Patent
Yamashita et al.

(10) Patent No.: US 12,078,183 B2
(45) Date of Patent: Sep. 3, 2024

(54) CEILING FAN

(71) Applicant: Panasonic Intellectual Property Management Co., Ltd., Osaka (JP)

(72) Inventors: Tatsuya Yamashita, Aichi (JP); Shigeo Itou, Aichi (JP); Hiroyuki Kuramochi, Aichi (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 180 days.

(21) Appl. No.: 17/631,961

(22) PCT Filed: Sep. 24, 2020

(86) PCT No.: PCT/JP2020/036013
§ 371 (c)(1),
(2) Date: Feb. 1, 2022

(87) PCT Pub. No.: WO2021/060372
PCT Pub. Date: Apr. 1, 2021

(65) Prior Publication Data

US 2022/0290681 A1 Sep. 15, 2022

(30) Foreign Application Priority Data

Sep. 27, 2019 (JP) ..... 2019-176620
Mar. 30, 2020 (JP) ..... 2020-059442
Jul. 31, 2020 (JP) ..... 2020-129987

(51) Int. Cl.
*F04D 25/08* (2006.01)
*F04D 25/06* (2006.01)
(Continued)

(52) U.S. Cl.
CPC ..... *F04D 25/088* (2013.01); *F04D 25/06* (2013.01); *F04D 27/008* (2013.01); *F04D 29/34* (2013.01)

(58) Field of Classification Search
CPC ..... F04D 25/06; F04D 25/088; F04D 27/008; F04D 29/34; F04D 27/001; F04D 27/004; F04D 25/0666
See application file for complete search history.

(56) References Cited

U.S. PATENT DOCUMENTS

2009/0208333 A1* 8/2009 Smith ..... F04D 29/384 416/61
2010/0129225 A1* 5/2010 Itou ..... F04D 29/023 416/204 R
(Continued)

FOREIGN PATENT DOCUMENTS

JP 62-032297 A 2/1987
JP H11132192 A * 10/1997
(Continued)

OTHER PUBLICATIONS

International Search Report and Written Opinion issued in International Patent Application No. PCT/JP2020/036013, dated Dec. 8, 2020; with partial English translation.

*Primary Examiner* — Alexander B Comley
(74) *Attorney, Agent, or Firm* — Rimon P.C.

(57) ABSTRACT

A fan blade includes a blade body blowing air and a root portion secured to a support part. A first end part of a fall prevention member is attached to a first mount portion provided in the support part, and a second end part of the fall prevention member is attached to a second mount portion provided in the blade body. A controller controls electric energization to a DC motor to cause the fan blade to stop rotating when the fan blade breaks, the blade body is retained by the fall prevention member, the blade body is
(Continued)

tilted, and at least one of a current value or a rotation speed measured by a measurer changes from a predetermined value.

2 Claims, 15 Drawing Sheets

(51) Int. Cl.
*F04D 27/00* (2006.01)
*F04D 29/34* (2006.01)

(56) References Cited

U.S. PATENT DOCUMENTS

| | | | |
|---|---|---|---|
| 2012/0039717 | A1 | 2/2012 | Itou et al. |
| 2017/0218962 | A1 | 8/2017 | Yamamoto et al. |

FOREIGN PATENT DOCUMENTS

| | | | | | |
|---|---|---|---|---|---|
| JP | 2006097642 | A | * | 4/2006 | |
| JP | 2009041392 | A | * | 2/2009 | ..... F04D 25/0606 |
| JP | 2011-058501 | A | | 3/2011 | |
| JP | 2018-053778 | A | | 4/2018 | |
| WO | 2016/051665 | A1 | | 4/2016 | |

* cited by examiner

CEILING FAN

CROSS-REFERENCE OF RELATED APPLICATIONS

This application is the U.S. National Phase under 35 U.S.C. § 371 of International Patent Application No. PCT/JP2020/036013, filed on Sep. 24, 2020, which in turn claims the benefit of Japanese Application No. 2019-176620, filed on Sep. 27, 2019, Japanese Application No. 2020-059442, filed on Mar. 30, 2020, Japanese Application No. 2020-129987, filed on Jul. 31, 2020, the entire disclosures of which Applications are incorporated by reference herein.

BACKGROUND

Technical Field

The present disclosure relates to a ceiling fan suspended from a ceiling.

Background Art

A conventional ceiling fan includes a motor attachable to a ceiling, a support frame to be rotated by the motor, fan blades attached to the support frame, and a fall prevention member engageable with the fan blades and the support frame. Each of the fan blades includes a root portion to be secured to the support frame. The root portion of the fan blade is provided with a through-hole through which the fall prevention member penetrates. When the root portion is broken and the fan blade is dislocated, the fan blade is allowed to engage with the support frame by the fall prevention member.

CITATION LIST

Patent Literature

PTL 1: International Publication No. 2016/051665

SUMMARY

In such a conventional ceiling fan, stress concentrates on the root portion of the fan blade due to the reaction of the fan blade pushing the air downward. As a consequence, the fan blade may break after a long-term use. Even if a fan blade breaks, the fall prevention member retains the fan blade to the motor, so the fan blade does not come off from the motor. However, because the motor continues to rotate, the fan blade also continues to rotate with the fan blade being retained. Therefore, further increased safety is required.

The present disclosure provides a solution to the foregoing and other problems, and it is an object of the disclosure to provide a ceiling fan such that, even when stress is applied to the root portion of a fan blade and the fan blade is broken, the fan blade can be retained to the motor and the motor can be automatically stopped.

A ceiling fan according to an aspect of the present disclosure includes a DC motor, a support part rotated by the DC motor, a fan blade attached to the support part, a fall prevention member engaged with the fan blade and the support part, a controller controlling electric energization to the DC motor, and a measurer measuring at least one of a value of current flowing to the DC motor and a rotation speed of the DC motor. The fan blade includes a blade body blowing air and a root portion secured to the support part.

The fall prevention member includes a first end part, a connecting plate part extending along a longitudinal axis of the fan blade from the first end part, and a second end part disposed at a distal end of the connecting plate part. The first end part is attached to a first mount portion disposed in the support part, and the second end part is attached to a second mount portion disposed on the blade body. The controller controls the electric energization to the DC motor to cause the fan blade to stop rotating, when the fan blade breaks and the blade body is thereby retained to the support part by the fall prevention member to be tilted, thereby causing the at least one of the value of current and the rotation speed measured by the measurer to change from a predetermined value.

A ceiling fan according to an embodiment of the present disclosure controls electric energization to the DC motor when at least one of the current value or the rotation speed of the DC motor changes from a predetermined value. As a result, the ceiling fan according to the present disclosure is able to stop the electric energization when a fan blade breaks and the blade body is retained to the support part by the fall prevention member.

DESCRIPTION OF EMBODIMENTS

Hereafter, exemplary embodiments of the present disclosure will be described with reference to the drawings.

First Exemplary Embodiment

Figure 1:
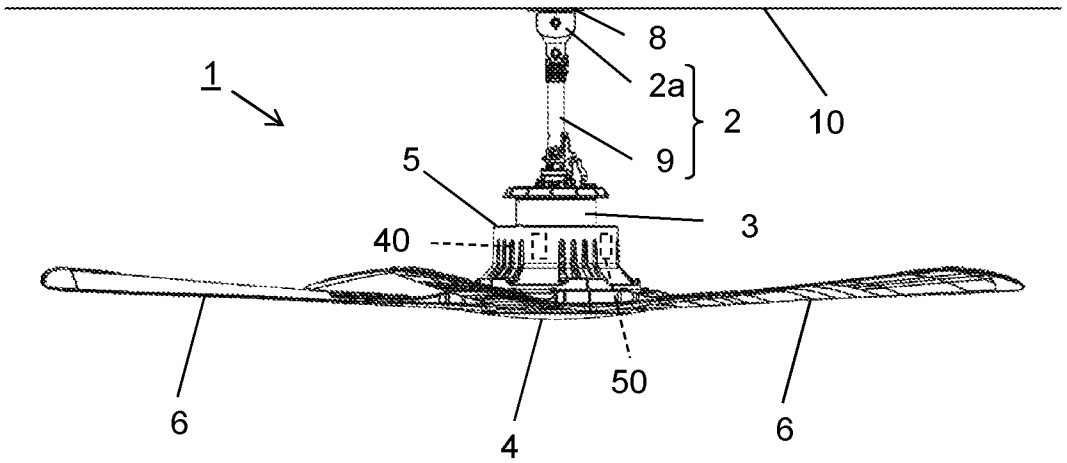
FIG. 1 is a side view illustrating a ceiling fan according to a first exemplary embodiment of the present invention.
Figure 2:
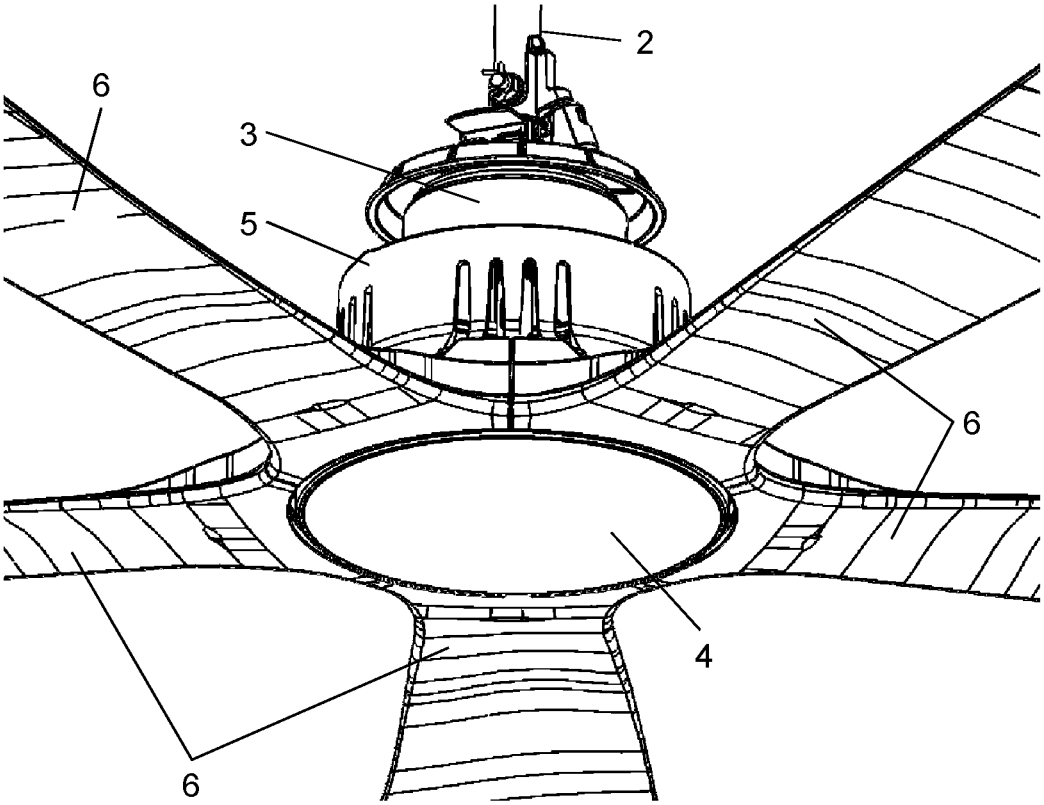
FIG. 2 is a partially enlarged view of the ceiling fan.
Figure 3:
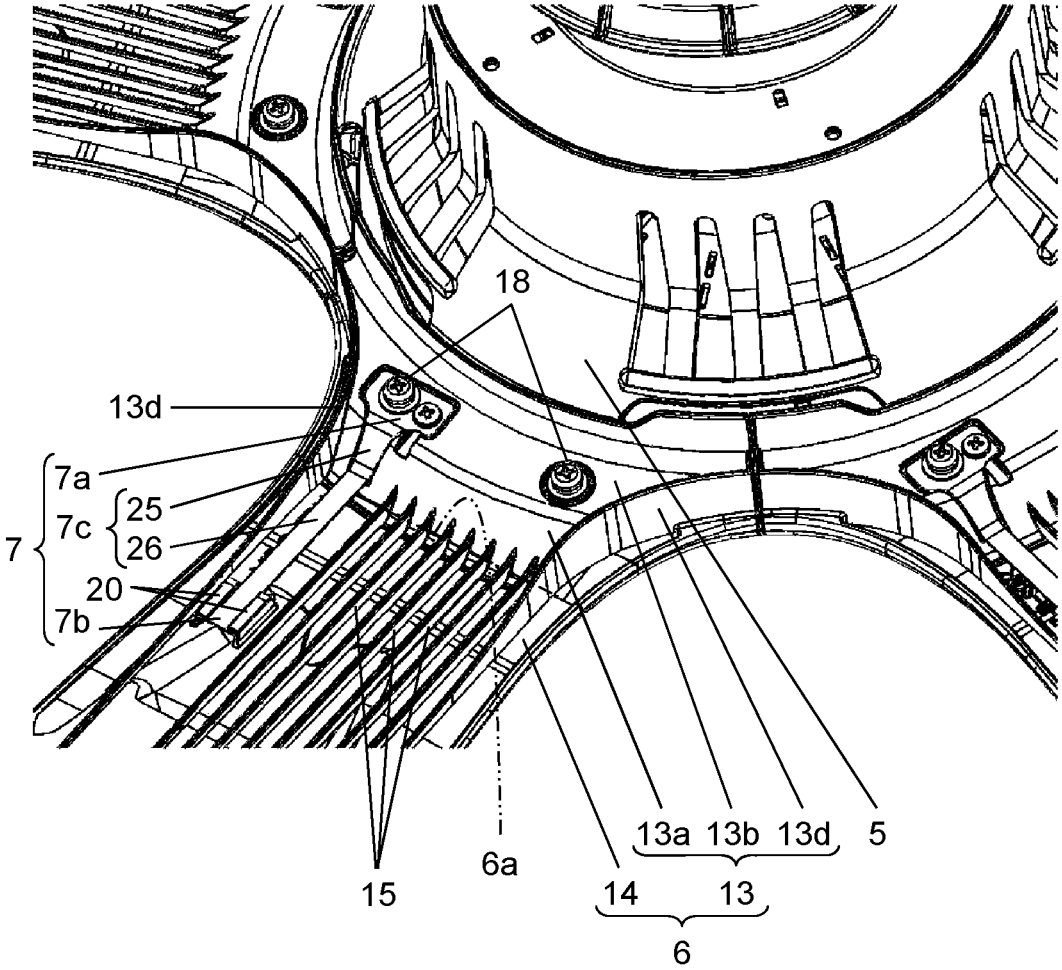
FIG. 3 is a partially enlarged view of the ceiling fan illustrating a portion where a fan blade is mounted to a support part.

FIG. 1 is a side view illustrating ceiling fan 1 according to a first exemplary embodiment of the present disclosure. FIG. 2 is a partially enlarged view of ceiling fan 1. FIG. 3 is a partially enlarged view illustrating a portion of fan blade 6 mounted to support part 5 of ceiling fan 1.

As illustrated in FIGS. 1, 2, and 3, ceiling fan 1 includes connecting part 2, DC motor 3, motor cover 4, support part 5, fan blades 6, fall prevention member 7, controller 40, and measurer 50.

Connecting part 2 includes joint portion 2*a* engaged with suspension part 8 fixed to ceiling 10, and pipe part 9 fixed to a lower portion of joint portion 2*a*. Because joint portion 2*a* is engaged with and suspended by suspension part 8, connecting part 2 is supported on ceiling 10 via suspension part 8. It is also possible that ceiling fan 1 may not be provided with suspension part 8, but connecting part 2 may be directly suspended from ceiling 10.

DC motor 3 is supported by connecting part 2. DC motor 3 includes a substantially circular-shaped stator (not shown) that is fixed to a lower portion of pipe part 9 and a substantially annular rotor (not shown) that rotates around the stator. DC motor 3 is electrically energized so that the rotor rotates around the stator. Support part 5 is fixed to a circumferential edge of the rotor, and support part 5 rotates integrally with the rotor. Motor cover 4 is fitted to DC motor 3 so as to cover a lower portion of DC motor 3. DC motor 3 is electrically connected to controller 40 and measurer 50.

Figure 4:
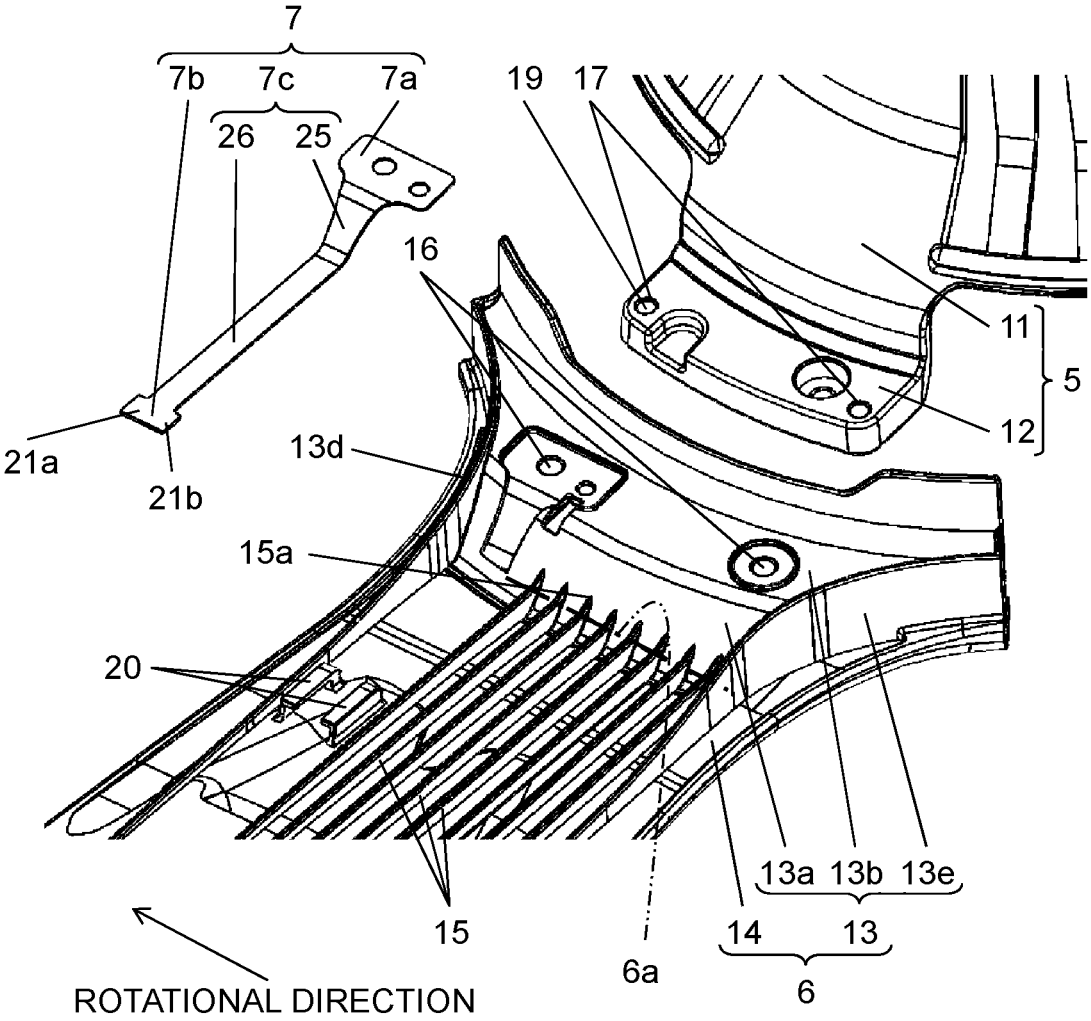
FIG. 4 is another partially enlarged view of the ceiling fan illustrating the portion where the fan blade is mounted to the support part.

FIG. 4 is a partially enlarged view illustrating a portion of fan blade 6 mounted to support part 5 of ceiling fan 1. FIG. 4 shows a state in which fan blade 6 and fall prevention member 7 are detached from support part 5.

As illustrated in FIGS. 2, 3, and 4, a plurality fan blades 6 are detachably attached to support part 5. Support part 5 includes annular-shaped outer shell 11 and a plurality of securing portions 12 each extending downward and radially outward from outer shell 11. Root portion 13 of fan blade 6 is mounted to securing portion 12, and fan blade 6 is detachably secured to securing part 12 with screws, each of which is fastening member 18.

Fan blade 6 includes root portion 13, which is mounted on securing portion 12 of support part 5, and blade body 14, which is positioned radially outward of root portion 13 and is a portion that substantially blows air. Fan blade 6 is formed of, for example, a resin material, and root portion 13 and blade body 14 are formed integrally with each other. Blade body 14 has a curved surface such that, in the widthwise axis, its forward edge with respect the rotational direction of fan blade 6 is lower than its rearward edge with respect the rotational direction of fan blade 6. In addition, in order to increase rigidity, fan blade 6 is provided with a plurality of protruding ribs (or recesses) 15 extending along its longitudinal axis.

Two fastening holes 16 are formed in root portion 13 of fan blade 6 near laterally opposite ends. Each securing portion 12 of support part 5 is provided with a plurality of holes 17. Fastening members 18 are inserted into fastening holes 16 in root portion 13 of fan blade 6 and holes 17 in securing portion 12, and root portion 13 is fastened to securing portion 12, whereby root portion 13 is mounted and attached to securing portion 12.

Fall prevention member 7 is in a substantially elongated plate shape, and fall prevention member 7 includes first end part 7*a*, connecting plate part 7*c* extending from first end part 7*a* in a longitudinal axis of fan blade 6, second end part 7*b* disposed at a distal end of connecting plate part 7*c*. First end part 7*a*, connecting plate part 7*c*, and second end part 7*b* are formed integrally with each other. An example of the material of fall prevention member 7 is metal.

First end part 7*a* has a shape such that a flat plate has a hole for inserting a screw. First end part 7*a* is disposed on root portion 13 of fan blade 6. First end part 7*a* is attached to a first mount portion 19, which is provided in securing portion 12 of support part 5. First mount portion 19 is one of holes 17 provided in securing portion 12. As an example, fall prevention member 7 is secured to securing portion 12 of support part 5 with fastening member 18 such as a screw.

Connecting plate part 7*c* includes first connecting plate portion 25 and second connecting plate portion 26.

First connecting plate portion 25 is an elongated flat plate and extends downward from an edge of first end part 7*a* along root portion 13 of fan blade 6.

Second connecting plate portion 26 is an elongated flat plate and extends from an end (lower end) of first connecting plate portion 25 toward the tip end of fan blade 6. At an end of second connecting plate portion 26 toward the tip end of fan blade 6, second end part 7*b* is provided. Connecting plate part 7*c* has an L-shaped cross-sectional shape along its longitudinal direction.

Second end part 7*b* includes forward protruding portion 21*a* and rearward protruding portion 21*b*, which protrude perpendicularly to the longitudinal axis of second connecting plate portion 26 from the tip end portion of second connecting plate portion 26. Forward protruding portion 21*a* protrudes forward with respect to the rotational direction of fan blade 6. Rearward protruding portion 21*b* protrudes rearward with respect to the rotational direction of fan blade 6. Forward protruding portion 21*a* and rearward protruding portion 21*b* are disposed to be on the same plane as second connecting plate portion 26. Forward protruding portion 21*a* and rearward protruding portion 21*b* are disposed to be on the same plane as second connecting plate portion 26. Second end part 7*b* is attached to second mount portion 20 of provided in blade body 14. When fan blade 6 breaks, fall prevention member 7 secured to securing portion 12 of support part 5 retains blade body 14 to securing portion 12. Note that the rotational direction of fan blade 6 is clockwise when fan blade 6 is viewed from above.

Controller 40 is electrically connected to a power switch (not shown), a low/high mode selector switch (not shown), and the like, which are provided on a wall. Controller 40 is provided below DC motor 3. Controller 40 controls electric energization (voltage) to DC motor 3 based on a signal from the power switch or the low/high mode selector switch.

Measurer 50 measures at least one of the current value flowing into DC motor 3 or the rotation speed of DC motor 3. Measurer 50 is provided below DC motor 3. An example of measurer 50 that measures the current value flowing into DC motor 3 is a circuit using a magnetic sensor. For example, a circuit using a Hall element, which is a magnetic sensor, converts the magnetic field generated by the current flowing through a coil (not shown) inside DC motor 3 into a voltage, to perform measurement. The circuit using the Hall element convers the measured value into a current value. An example of measurer 50 that measures the rotation speed of DC motor 3 is a circuit using a magnetic sensor. For example, a circuit using a plurality of Hall elements, which are magnetic sensors, is used to detect a rotational position of the rotor, and the rotation speed is detected from the detected rotational position.

Figure 5:
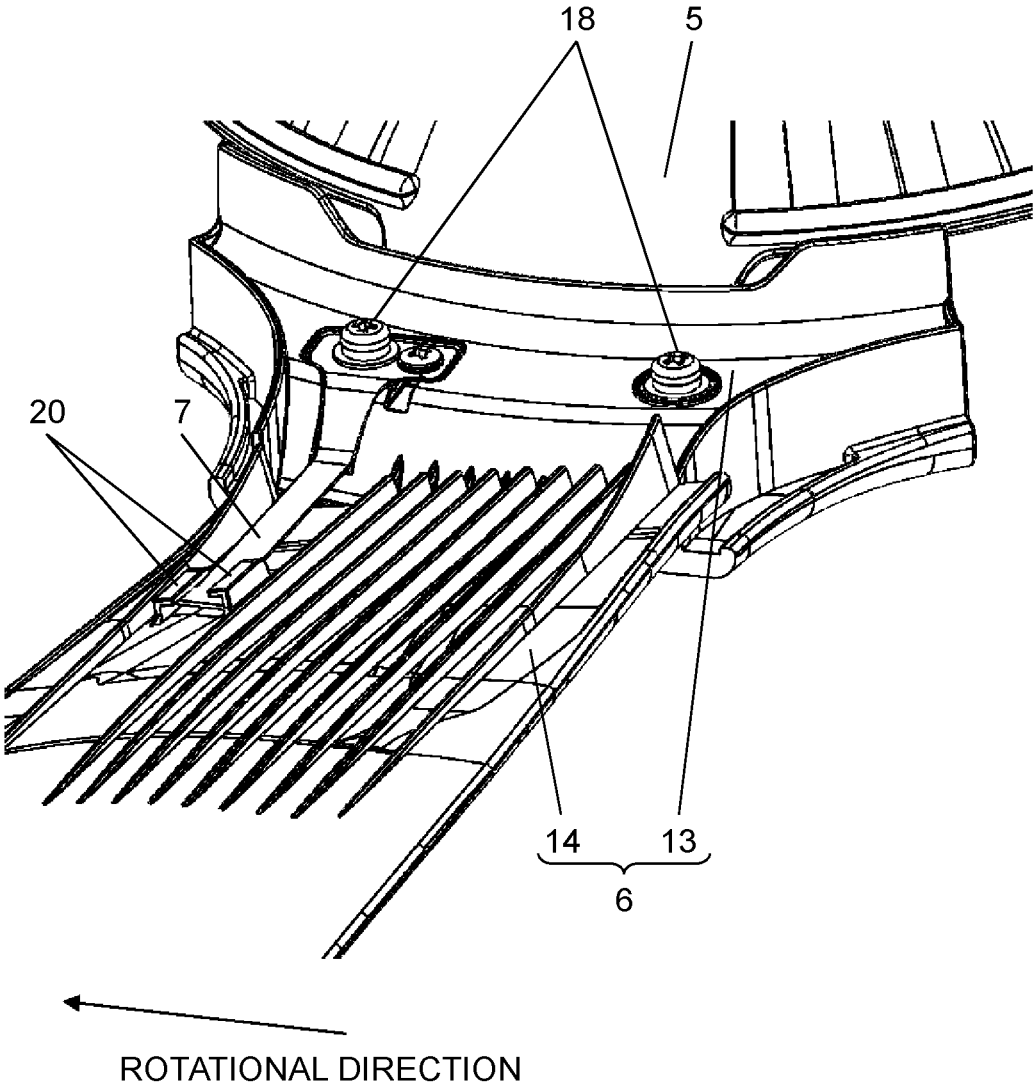
FIG. 5 is a view illustrating a state of the ceiling fan in which the fan blade is retained by a fall prevention member when the portion of the fan blade mounted to the support part is broken.

FIG. 5 is a view illustrating a state in which fall prevention member 7 retains fan blade 6 when a mount portion of fan blade 6 to support part 5 provided in ceiling fan 1 is broken.

As illustrated in FIGS. 3, 4, and 5, a characteristic feature of the present exemplary embodiment is that, when fan blade 6 is broken during operation of ceiling fan 1 to cause blade body 14 to be retained to support part 5 by fall prevention member 7 and the current value measured by measurer 50 becomes greater than a predetermined value, controller 40 controls electric energization to DC motor 3 to cause fan blade 6 to stop rotating. Alternatively, a characteristic feature of the present exemplary embodiment is that, when fan blade 6 is broken during operation of ceiling fan 1 to cause blade body 14 to be retained to support part 5 by fall prevention member 7 and the rotation speed measured by measurer 50 becomes smaller than a predetermined value, controller 40 controls electric energization to DC motor 3 to cause fan blade 6 to stop rotating.

More specifically, when breakage or the like occurs in fan blade 6 during operation of ceiling fan 1, blade body 14 tries to detach in an outward direction (radially outward) from securing portion 12 of support part 5 due to the centrifugal force. Blade body 14 is brought into a state such as to be rotating while being retained to support part 5 by fall prevention member 7. In this way, when blade body 14 is retained by fall prevention member 7, retained blade body 14 tilts, which causes resistance to the rotation of DC motor 3, so that the rotation speed of DC motor 3 decreases. When the rotation speed of DC motor 3 decreases, the value of current flowing to DC motor 3 increases. This current value is measured by measurer 50. Controller 40 compares the current value measured by measurer 50 with a predetermined current value that has been set in advance, and if the change in the current value measured by measurer 50 becomes greater than a predetermined value, controller 40 controls electric energization to DC motor 3 to cause fan blade 6 to stop rotating. Note that controller 40 may compare the current value itself, instead of a change in the current value, with a predetermined value to control electric energization to DC motor 3.

Alternatively, controller 40 may compare the rotation speed measured by measurer 50 with a predetermined rotation speed that has been set in advance, and if the rotation speed measured by measurer 50 becomes less than a predetermined rotation speed, controller 40 may control electric energization to DC motor 3 to cause fan blade 6 to stop rotating.

As a result, it is possible to stop electric energization to DC motor 3 when fan blade 6 breaks and blade body 14 tries to detach from securing portion 12. It should be noted that ceiling fan 1 may stop electric energization to DC motor 3 based on at least one of the value of current measured by measurer 50 or the rotation speed measured by measurer 50.

Figure 6:
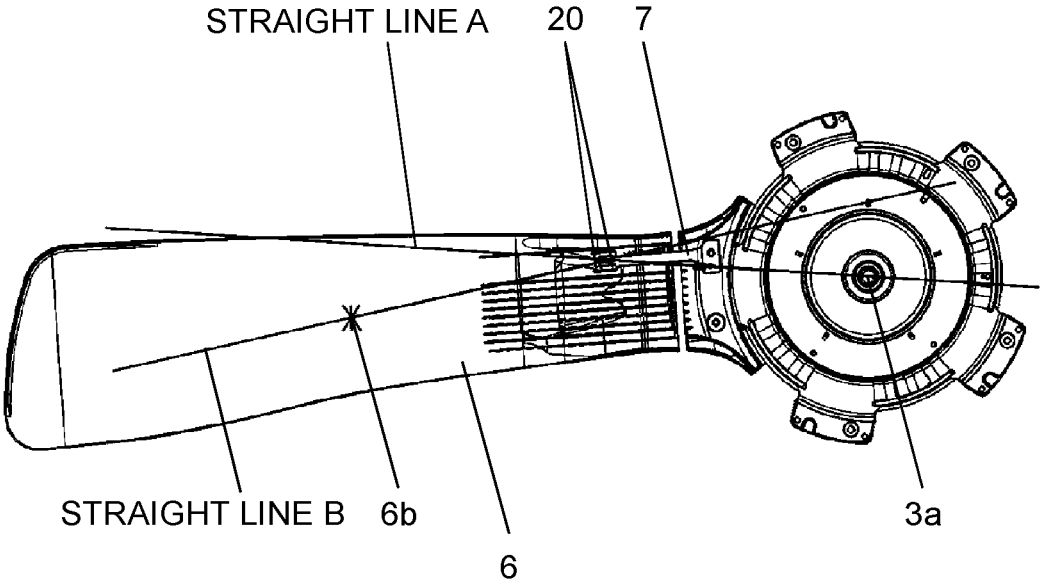
FIG. 6 is a plan view illustrating a fan blade of the ceiling fan.

FIG. 6 is a plan view illustrating fan blade 6 of ceiling fan 1. FIG. 6 shows a state in which fan blade 6 has broken.

As illustrated in FIGS. 3, 4, 5, and 6, fan blade 6 includes stress concentrated location 6*a* (a portion indicated by the dash-dot-dot line in FIGS. 3 and 4) between first mount portion 19 and second mount portion 20, on which stress concentrates when fan blade 6 rotates. When fan blade 6 rotates, the maximum stress that acts on stress concentrated location 6*a* is greater than the maximum stress that acts on the circumferential edge of fastening hole 16 in root portion 13 of fan blade 6, which is fastened to securing portion 12 by fastening member 18 such as a screw. Therefore, it is believed that when fan blade 6 breaks, stress concentrated location 6*a* breaks first.

As illustrated in FIG. 6, second mount portion 20 is provided in blade body 14 such that straight line A and straight line B intersect. Straight line A is a straight line that connects second mount portion 20 and rotational axis 3*a* of DC motor 3. Straight line B is a straight line that connects second mount portion 20 and center of gravity 6*b* of fan blade 6 in blade body 14 that has broken off at stress concentrated location 6*a*. In other words, center of gravity 6*b* of fan blade 6 that is in blade body 14 that has broken off is not disposed on straight line A, which connects second mount portion 20 (second end part 7*b* of fall prevention member 7) and rotational axis 3*a* of DC motor 3.

Accordingly, when fan blade 6 has broken off, center of gravity 6*b* of the portion of fan blade 6 that is retained by fall prevention member 7 (i.e., the portion of fan blade 6 that is in blade body 14 that has broken off at stress concentrated location 6*a*) moves onto straight line A, which connects second end part 7*b* and rotational axis 3*a* of DC motor 3. This causes fan blade 6 that has been broken off and retained by fall prevention member 7 to tilt, so that fan blade 6 easily provides resistance to rotation of DC motor 3. The reason is believed to be that, when fan blade 6 breaks and the broken portion of fan blade 6 that has been detached from securing portion 12 of support part 5 (i.e., the portion of fan blade 6 that is in blade body 14 that has broken off at stress concentrated location 6*a*) rotates while being retained to securing portion 12 by fall prevention member 7, the centrifugal force acting on the broken fan blade 6 exerts a force on fan blade 6 such as to bring rotational axis 3*a*, second end part 7*b*, and center of gravity 6*b* into substantially a straight line.

Figure 7:
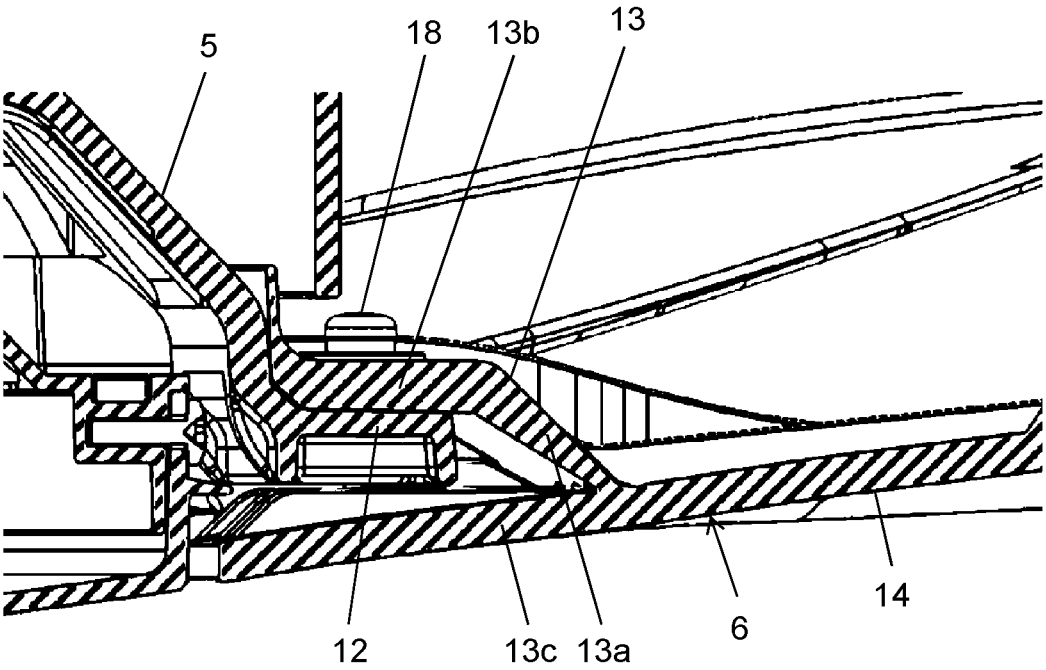
FIG. 7 is a cross-sectional view illustrating a support part and a root portion of a fan blade of the ceiling fan.
Figure 8:
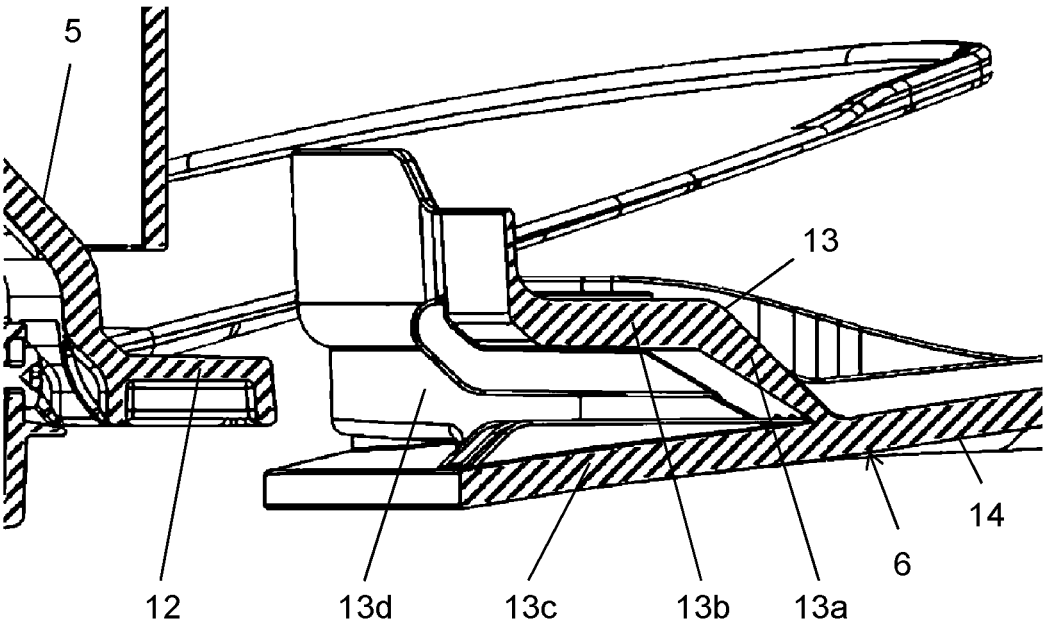
FIG. 8 is another cross-sectional view illustrating the support part and the root portion of the fan blade of the ceiling fan.

FIG. 7 is a cross-sectional view illustrating support part 5 of ceiling fan 1 and root portion 13 of fan blade 6, showing a state in which root portion 13 of fan blade 6 is fixed to support part 5. FIG. 8 is another cross-sectional view illustrating support part 5 of ceiling fan 1 and root portion 13 of fan blade 6, showing a state in which root portion 13 of fan blade 6 is detached from support part 5.

As illustrated in FIGS. 4, 7, and 8, root portion 13 of fan blade 6 has a substantially box shape with one side open and has a structure such as to cover securing portion 12 of support part 5, which is in a thick plate shape. Securing portion 12 has such a structure such as to be inserted into the inside of root portion 13 from the opening of the one side of root portion 13 of fan blade 6. Root portion 13 includes side plate 13*a*, upper plate 13*b*, lower plate 13*c*, and connecting plates 13*d* and 13*e*. Side plate 13*a*, upper plate 13*b*, lower plate 13*c*, and connecting plates 13*d* and 13*e* are formed integrally with each other.

Side plate 13*a* is a side surface that is opposed to the opening of root portion 13, which has a substantially box shape with one side open. Side plate 13*a* is in a laterally elongated flat plate shape. Side plate 13*a* protrudes upward from the upper surface of blade body 14 and extends in a widthwise direction of blade body 14. Blade body 14 has an elongated plate shape extending radially outward from root portion 13. The shorter sides of side plate 13*a* extend along a vertical direction and the longer sides of side plate 13*a* extend along a lateral direction (widthwise direction of blade body 14). Side plate 13*a* is inclined toward the center of rotation of fan blade 6 from a lower portion of side plate 13*a* toward an upper portion thereof.

Upper plate 13*b* is an upper surface of root portion 13, which is in a substantially box shape with one side open. Upper plate 13*b* is in a laterally elongated flat plate and extends toward the center of rotation of fan blade 6 from the upper edge of an upper portion of side plate 13*a*. The shorter sides of upper plate 13*b* extend from the tip end toward the root end of fan blade 6, and the longer sides of upper plate 13*b* extend along a lateral direction (widthwise direction of blade body 14). Upper plate 13*b* includes two fastening holes 16. Fastening members 18, such as screws, are inserted through fastening holes 16 and holes 17 in securing portion 12 so that root portion 13 is fastened to the upper surface of securing portion 12.

Lower plate 13*c* is a lower surface of root portion 13, which is in a substantially box shape with one side open. Lower plate 13*c* is in a laterally elongated flat plate and extends toward the center of rotation of fan blade 6 from the lower end of a lower portion of side plate 13*a*. The shorter sides of lower plate 13*c* extend from the tip end toward the root end of fan blade 6, and the longer sides of lower plate 13*c* extend along a lateral direction (along the widthwise axis of blade body 14). The lower plate 13*c* and the blade body 14 form the same surface.

Connecting plates 13*d* and 13*e* are side surfaces that are opposed to each other in root portion 13 that is in a substantially box shape with one side open. Connecting plates 13*d* and 13*e* are in a laterally elongated flat plate shape. Each of connecting plates 13*d* and 13*e* is configured to protrude upward from the upper surface of blade body 14 and connect an end of upper plate 13*b*, an end of side plate 13*a*, and an end of lower plate 13*c*. Specifically, connecting plate 13*d* connects the end of upper plate 13*b*, the end of side plate 13*a*, and the end of lower plate 13*c* that are located forward with respect to the rotational direction of fan blade 6, and connecting plate 13*e* connects the end of upper plate 13*b*, the end of side plate 13*a*, and the end of lower plate 13*c* that are located rearward with respect to the rotational direction of fan blade 6.

Blade body 14, which extends radially outward from root portion 13, has a plurality of protruding ribs 15, which serve as reinforcing portions an elongated plate shape extending radially outward. Each of protruding ribs 15 has a thin plate shape extending in a radial direction. Each of protruding ribs 15 protrudes upward from the upper surface of blade body 14 and extends toward the tip end of blade body 14. The shorter sides of each protruding rib 15 extend along a vertical direction and the longer sides of each protruding rib 15 extend in a radial direction (from side plate 13*a* toward the tip end of blade body 14). The plurality of protruding ribs 15 are arranged parallel to each other. The thickness of protruding rib 15 is thinner than the thickness of blade body 14, and the height of protruding rib 15 is smaller than the height of side plate 13*a*.

As seen in the above-described configuration, root portion 13 of fan blade 6 is in a substantially box shape with one side open, and the upper surface of blade body 14 extending radially outward from root portion 13 is provided with the plurality of protruding ribs 15, which are reinforcing portions, extending from side plate 13*a* toward the tip of blade body 14. Thus, each of the boundary between protruding ribs 15 and side plate 13*a* and the boundary between side plate 13*a* and blade body 14 is stress concentrated location 6*a*. The maximum stress that acts on stress concentrated location 6*a* is greater than the maximum stress that acts on the circumferential edges of the fastening holes 16. Therefore, it is believed that when fan blade 6 breaks, stress concentrated location 6*a* breaks first. More specifically, it is believed that when fan blade 6 breaks, protruding rib 15 that is near the boundary between protruding rib 15 and side plate 13*a* (for example, curved surface portion 15 of protruding rib 15) breaks first, and next, the boundary between side plate 13*a* and blade body 14 breaks. Stress concentrated location 6*a* is located between first mount portion 19 and second mount portion 20. Therefore, when fan blade 6 breaks, a portion of fan blade 6 in blade body 14 that has broken off at stress concentrated location 6*a* is reliably retained to securing portion 12 of support part 5 by fall prevention member 7.

In addition, a clearance gap is provided between securing portion 12 of support part 5 and side plate 13*a*, lower plate 13*c*, and connecting plates 13*d* and 13*e*, which are root portion 13 of fan blade 6. As a result, when root portion 13 of fan blade 6, which is in a substantially box shape with one side open, is attached to securing portion 12 of support part 5, which is in a thick plate shape, root portion 13 is less likely to be affected by the stress resulting from press-fitting than in cases where there is no clearance gap between securing portion 12 and side plate 13*a*, lower plate 13*c*, and connecting plates 13*d* and 13*e*. Therefore, durability of root portion 13 improves.

Figure 9A:
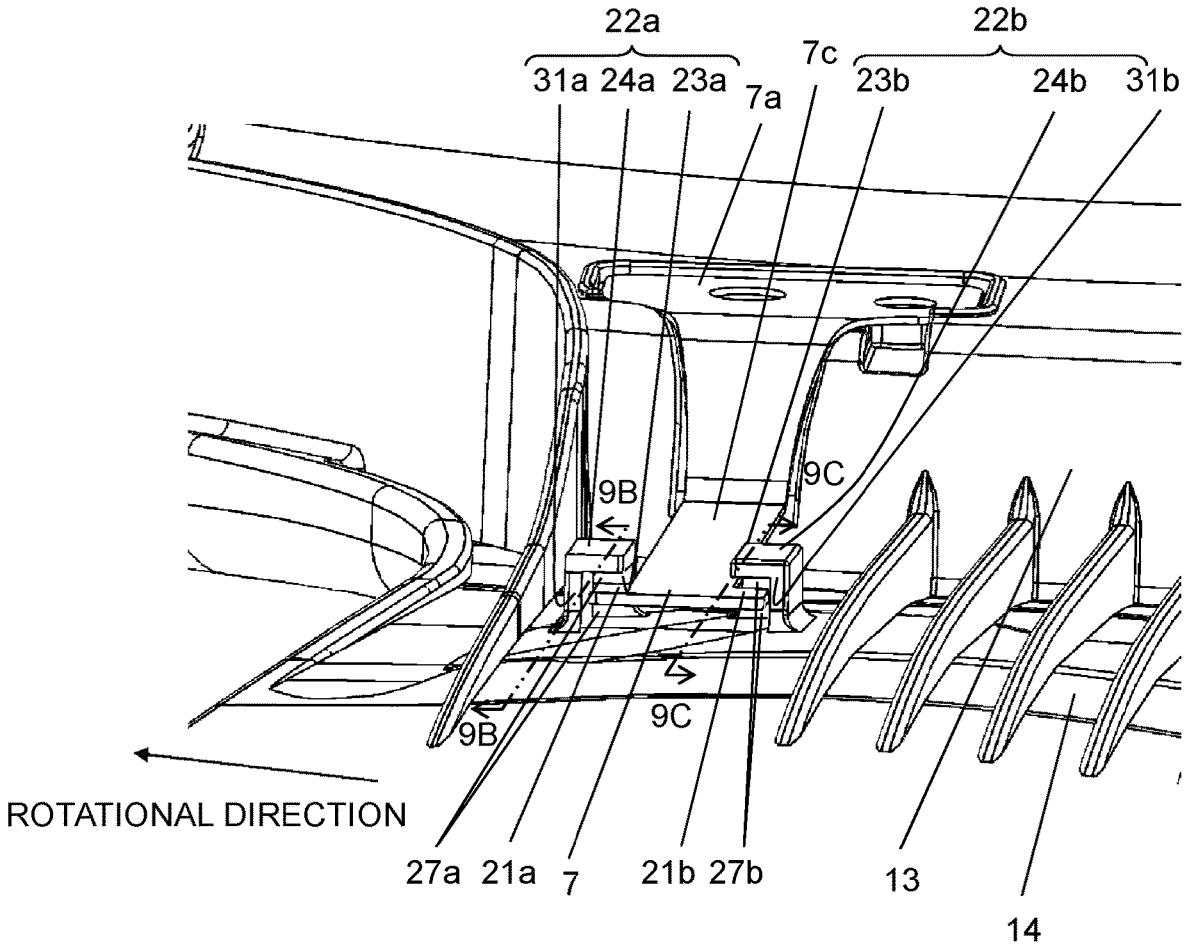
FIG. 9A is a partially enlarged view illustrating a portion of the ceiling fan where the fall prevention member is mounted.
Figure 9B:
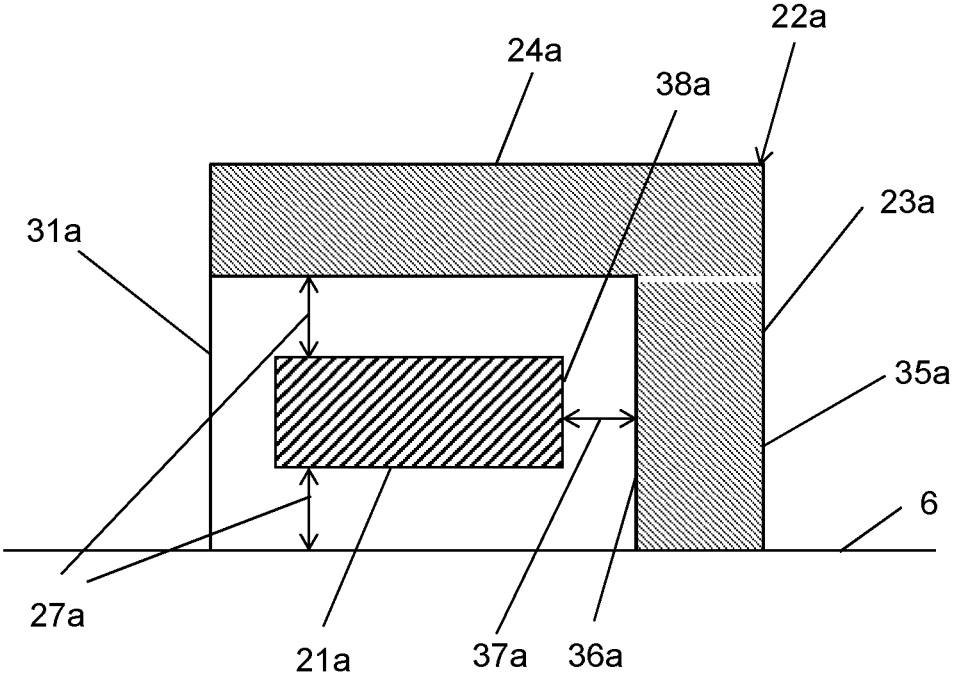
FIG. 9B is a cross-sectional view of the ceiling fan, taken along line 9B-9B in FIG. 9A.
Figure 9C:
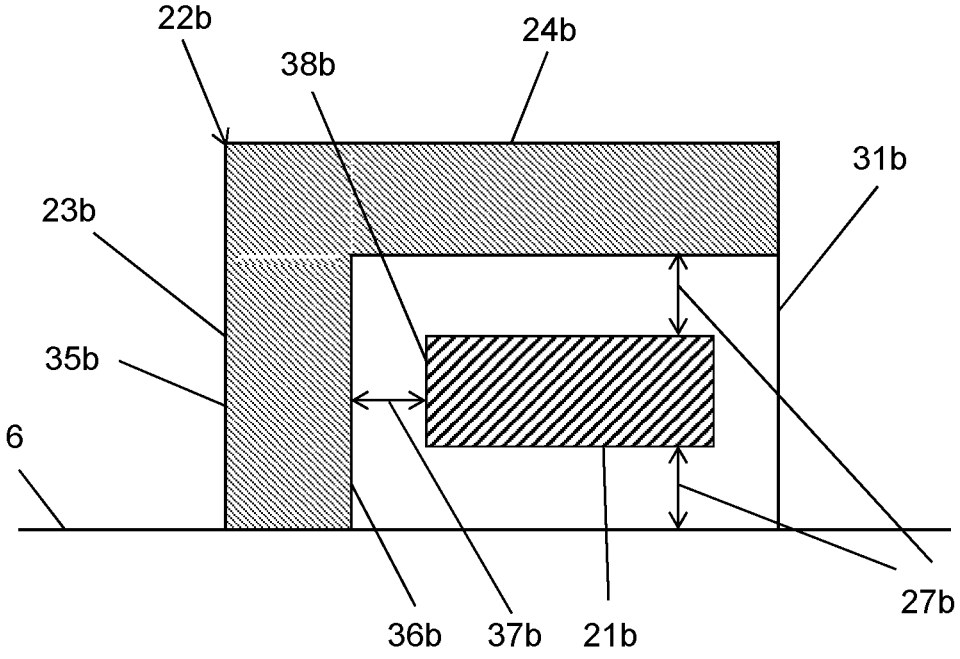
FIG. 9C is a cross-sectional view of the ceiling fan, taken along line 9C-9C in FIG. 9A.

FIG. 9A is a partially enlarged view illustrating a portion of ceiling fan 1 in which fall prevention member 7 is mounted. FIG. 9B is a cross-sectional view of ceiling fan 1, taken along line 9B-9B in FIG. 9A. FIG. 9C is a cross-sectional view of ceiling fan 1, taken along line 9C-9C in FIG. 9A. In FIG. 9B, the left side is the tip side of fan blade 6, and the right side is the root side of fan blade 6. In FIG. 9C, the left side is the root side of fan blade 6, and the right side is the tip side of fan blade 6.

As illustrated in FIGS. 4, 5, 9A, 9B, and 9C, second end part 7*b* and second mount portion 20 are attached pivotably so that when fan blade 6 breaks, a forward portion of blade body 14 that is forward with respect to the rotational direction and a rearward portion of blade body 14 that is rearward with respect to the rotational direction pivot vertically.

Specifically, in the widthwise direction of fan blade 6, second mount portion 20 is disposed forward with respect to the rotational direction of fan blade 6. Second mount portion 20 includes forward hook portion 22*a* onto which forward protruding portion 21*a* is hooked when fan blade 6 is broken, and rearward hook portion 22*b* onto which rearward protruding portion 21*b* is hooked when fan blade 6 is broken.

Forward hook portion 22*a* includes forward vertical plate 23*a*, forward horizontal plate 24*a*, and forward reinforcement plate 31*a*.

Forward vertical plate 23*a* is in a flat plate shape. Forward vertical plate 23*a* extends upward from the upper surface of blade body 14. First surface 35*a* of forward vertical plate 23*a* faces toward the root end of fan blade 6, and second surface 36*a* of forward vertical plate 23*a* faces toward the tip end of fan blade 6. Clearance gap 37*a* is provided between forward vertical plate 23*a* and forward protruding portion 21*a*. When fan blade 6 breaks, end 38*a* of forward protruding portion 21*a* that is located closer to the root end of fan blade 6 is hooked onto second surface 36*a* of forward vertical plate 23*a*.

Forward horizontal plate 24*a* is in a flat plate shape and extends from the upper end of forward vertical plate 23*a* toward the tip end of fan blade 6. The vertical cross-sectional shape of forward hook portion 22*a*, which includes forward vertical plate 23*a* and forward horizontal plate 24*a*, is an L-shape. Forward horizontal plate 24*a* covers the upper region of forward protruding portion 21*a* so that forward horizontal plate 24*a* prevents forward protruding portion 21*a* from being released from a hooked state on forward vertical plate 23*a*.

Forward reinforcement plate 31*a* is in a flat plate shape and extends upward from the upper surface of blade body 14. The first surface of forward reinforcement plate 31*a* faces forward with respect to the rotational direction of fan blade 6, and the second surface of forward reinforcement plate 31*a* faces rearward with respect to the rotational direction of fan blade 6. Forward reinforcement plate 31*a* connects a forward end of forward vertical plate 23*a* with respect to the rotational direction of fan blade 6, a forward end of forward horizontal plate 24*a* with respect to the rotational direction of fan blade 6, and blade body 14 to each other. Thereby, the strength of forward hook portion 22*a* is improved. A clearance gap is provided between forward reinforcement plate 31*a* and forward protruding portion 21*a*.

Rearward hook portion 22*b* includes rearward vertical plate 23*b*, rearward horizontal plate 24*b*, and rearward reinforcement plate 31*b*.

Rearward vertical plate 23*b* is in a flat plate shape. Rearward vertical plate 23*b* extends upward from the upper surface of blade body 14. First surface 35*b* of rearward vertical plate 23*b* faces toward the root end of fan blade 6, and second surface 36*b* of rearward vertical plate 23*b* faces toward the tip end of fan blade 6. Clearance gap 37*b* is provided between rearward vertical plate 23*b* and rearward protruding portion 21*b*. When fan blade 6 breaks, end 38*b* of rearward protruding portion 21*b* that is located closer to the root end of fan blade 6 is hooked onto second surface 36*b*.

Rearward horizontal plate 24*b* is in a flat plate shape and extends from the upper end of rearward vertical plate 23*b* toward the tip end of fan blade 6. The vertical cross-sectional shape of rearward hook portion 22*b*, which includes rearward vertical plate 23*b* and rearward horizontal plate 24*b*, is an L-shape. Rearward horizontal plate 24*b* covers the upper region of rearward protruding portion 21*b* so that rearward horizontal plate 24*b* prevents rearward protruding portion 21*b* from being released from a hooked state on rearward vertical plate 23*b*.

Rearward reinforcement plate 31*b* is in a flat plate shape and extends upward from the upper surface of blade body 14. The first surface of rearward reinforcement plate 31*b* faces forward with respect to the rotational direction of fan blade 6, and the second surface of rearward reinforcement plate 31*b* faces rearward with respect to the rotational direction of fan blade 6. Rearward reinforcement plate 31*b* connects a rearward end of rearward vertical plate 23*b* with respect to the rotational direction of fan blade 6, a rearward end of rearward horizontal plate 24*b* with respect to the rotational direction of fan blade 6, and blade body 14 to each other. Thereby, the strength of rearward hook portion 22*b* is improved. A clearance gap is provided between rearward reinforcement plate 31*b* and rearward protruding portion 21*b*.

It should be noted that the distance between forward vertical plate 23*a* and rearward vertical plate 23*b* is slightly greater than the width dimension of second connecting plate portion 26.

In the configuration as described above, until fan blade 6 breaks, clearance gap 27*a* is provided between the upper surface of forward protruding portion 21*a* and the lower surface of forward horizontal plate 24*a* and between the lower surface of forward protruding portion 21*a* and the upper surface of fan blade 6. Likewise, until fan blade 6 breaks, clearance gap 27*b* is provided between the upper surface of rearward protruding portion 21*b* and the lower surface of rearward horizontal plate 24*b* and between the lower surface of rearward protruding portion 21*b* and the upper surface of fan blade 6. Note that the clearance gap between the upper surface of forward protruding portion 21*a* and the lower surface of forward horizontal plate 24*a* and the clearance gap between the lower surface of forward protruding portion 21*a* and the upper surface of fan blade 6 may not be the same size. Also, the clearance gap between the upper surface of rearward protruding portion 21*b* and the lower surface of rearward horizontal plate 24*b* and the clearance gap between the lower surface of rearward protruding portion 21*b* and the upper surface of fan blade 6 may not be the same size.

When fan blade 6 breaks, a portion of blade body 14 that is forward with respect to the rotational direction of blade body 14 and a portion of blade body 14 that is rearward with respect to the rotational direction of blade body 14 pivot vertically and tilt in a widthwise direction of blade body 14 because of clearance gap 27*a* and clearance gap 27*b* with blade body 14 being connected to securing portion 12 of support part 5 by fall prevention member 7 and being pulled toward the tip end of blade body 14. At this time, end 38*a* of forward protruding portion 21*a* of fall prevention member 7 that is located closer to the root end of fan blade 6 is kept hooked onto second surface 36*a* of forward vertical plate 23*a*, and end 38*b* of rearward protruding portion 21*b* that is located closer to the root end of fan blade 6 is kept hooked onto second surface 36*b* of rearward vertical plate 23*b*. Furthermore, because fall prevention member 7 is deformed, a portion of blade body 14 that is forward with respect to the rotational direction of blade body 14 and a portion of blade body 14 that is rearward with respect to the rotational direction of blade body 14 pivot vertically and tilt in a widthwise direction of blade body 14.

Thus, clearance gap 27*a* and clearance gap 27*b* enable blade body 14 to tilt more easily when fan blade 6 breaks, so it is possible to provide resistance to rotation of DC motor 3 more quickly, to stop rotation of fan blade 6 quickly. Note that an example of the size of clearance gap 27*a* is such a size that the portion of blade body 14 that is forward with respect to the rotational direction of blade body 14 can tilt upward 30 degrees or downward 30 degrees from a predetermined position. Likewise, an example of the size of clearance gap 27*b* is such a size that the portion of blade body 14 that is forward with respect to the rotational direction of blade body 14 can tilt upward 30 degrees or downward 30 degrees from a predetermined position.

Second Exemplary Embodiment

Figure 10:
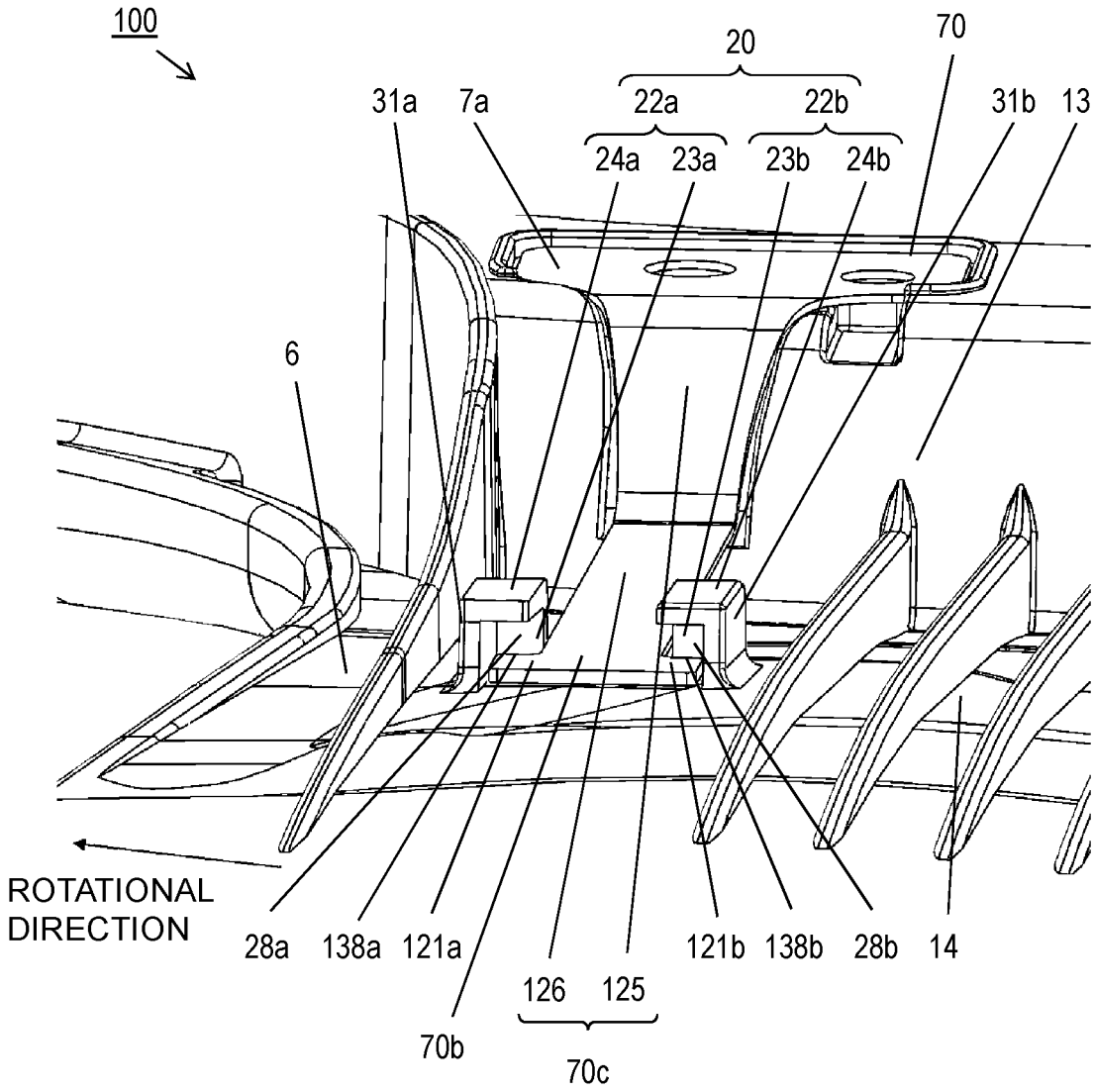
FIG. 10 is a partially enlarged view of a ceiling fan according to a second exemplary embodiment, illustrating a portion where a fall prevention member is mounted.

FIG. 10 is a partially enlarged view of ceiling fan 100 according to a second exemplary embodiment of the present disclosure, which illustrates a portion where fall prevention member 70 is mounted. The same elements as those in the first exemplary embodiment are designated by the same reference characters, and the description thereof will not be repeated.

As illustrated in FIG. 10, a difference from the first exemplary embodiment is the configuration of second end part 70*b* of fall prevention member 70 and second mount portion 20.

More specifically, until fan blade 6 breaks, the lower surface of forward protruding portion 121*a* is in contact with the upper surface of fan blade 6, and clearance gap 28*a* is provided between the upper surface of forward protruding portion 121*a* and forward horizontal plate 24*a* of forward hook portion 22*a*. Also, the lower surface of rearward protruding portion 121*a* is in contact with the upper surface of fan blade 6, and clearance gap 28*b* is provided between the upper surface of rearward protruding portion 121*a* and rearward horizontal plate 24*b* of rearward hook portion 22*b*. Because of clearance gap 28*a* and clearance gap 28*b*, the angle formed by first connecting plate portion 125 and second connecting plate portion 126, which form connecting plate part 70*c*, results in an obtuse angle.

When fan blade 6 breaks, a portion of blade body 14 that is forward with respect to the rotational direction of blade body 14 and a portion of blade body 14 that is rearward with respect to the rotational direction of blade body 14 pivot vertically and tilt in a widthwise direction of blade body 14 because of clearance gap 28*a* and clearance gap 28*b* in a state in which blade body 14 is connected to securing portion 12 of support part 5 by fall prevention member 70 and is pulled toward the tip end of blade body 14. At this time, end 138*a* of forward protruding portion 121*a* of fall prevention member 70 that is located closer to the root end of fan blade 6 is kept hooked onto second surface 36*a* of forward vertical plate 23*a*, and end 138*b* of rearward protruding portion 121*b* that is located closer to the root end of fan blade 6 is kept hooked onto second surface 36*b* of rearward vertical plate 23*b*. Furthermore, because fall prevention member 70 is deformed, a portion of blade body 14 that is forward with respect to the rotational direction of blade body 14 and a portion of blade body 14 that is rearward with respect to the rotational direction of blade body 14 pivot vertically and tilt in a widthwise direction of blade body 14.

In addition, because of clearance gap 28*a* and clearance gap 28*b* are provided, the bend of connecting plate part 70*c*, that is, the angle formed by first connecting plate portion 125 and second connecting plate portion 126, results in an obtuse angle. Here, when fan blade 6 breaks, fall prevention member 70 deforms, causing the angle formed by first connecting plate portion 125 and second connecting plate portion 126 to widen and become closer to 180 degrees. When the angle formed by first connecting plate portion 125 and second connecting plate portion 126 is set to an obtuse angle, the widening angle in the angle formed by first connecting plate portion 125 and second connecting plate portion 126 becomes smaller, so that the load acting on fall prevention member 70 can be alleviated.

Third Exemplary Embodiment

Figure 11:
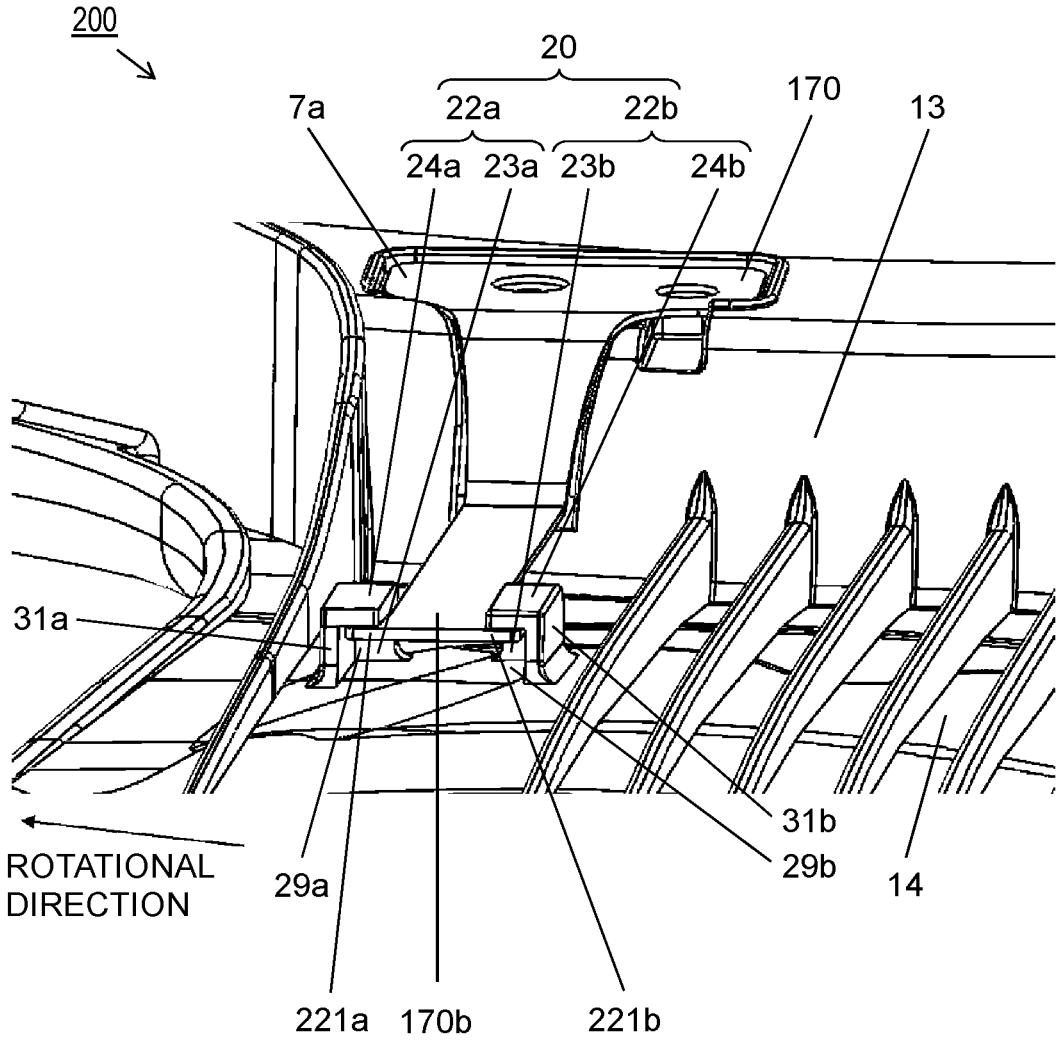
FIG. 11 is a partially enlarged view of a ceiling fan according to a third exemplary embodiment, illustrating a portion where a fall prevention member is mounted.

FIG. 11 is a partially enlarged view of ceiling fan 200 according to a third exemplary embodiment of the present disclosure, which illustrates a portion where fall prevention member 170 is mounted. The same elements as those in the first exemplary embodiment are designated by the same reference characters, and the description thereof will not be repeated.

As illustrated in FIG. 11, a difference from the first exemplary embodiment is the configuration of second end part 170*b* of fall prevention member 170 and second mount portion 20.

More specifically, until fan blade 6 breaks, clearance gap 29*a* is provided between the lower surface of forward protruding portion 221*a* and the upper surface of fan blade 6, and the upper surface of forward protruding portion 221*a* is in contact with the lower surface of forward horizontal plate 24*a* of forward hook portion 22*a*. Also, clearance gap 29*b* is provided between the lower surface of rearward protruding portion 221*b* and the upper surface of fan blade 6, and the upper surface of rearward protruding portion 221*b* is in contact with the lower surface of rearward horizontal plate 24*b* of rearward hook portion 22*b*.

When fan blade 6 breaks, a portion of blade body 14 that is forward with respect to the rotational direction of blade body 14 and a portion of blade body 14 that is rearward with respect to the rotational direction of blade body 14 pivot vertically and tilt in a widthwise direction of blade body 14 because of clearance gap 29*a* and clearance gap 29*b* with blade body 14 being connected to securing portion 12 of support part 5 by fall prevention member 170 and being pulled toward the tip end of blade body 14. At this time, the end of forward protruding portion 221*a* of fall prevention member 170 that is located closer to the root end of fan blade 6 is kept hooked onto second surface 36*a* of forward vertical plate 23*a*, and the end of rearward protruding portion 21*b* that is located closer to the root end of fan blade 6 is kept hooked onto second surface 36*b* of rearward vertical plate 23*b*. Furthermore, because fall prevention member 7 is deformed, a portion of blade body 14 that is forward with respect to the rotational direction of blade body 14 and a portion of blade body 14 that is rearward with respect to the rotational direction of blade body 14 pivot vertically and tilt in a widthwise direction of blade body 14.

In addition, when fan blade 6 breaks, the upper surface of forward protruding portion 221*a* of second end part 170*b* rubs against the lower surface of forward horizontal plate 24*a* of forward hook portion 22*a*, and the upper surface of rearward protruding portion 221*b* of second end part 170*b* rubs against the lower surface of rearward horizontal plate 24*b* of rearward hook portion 22*b*. This makes it possible to reduce the force exerted by forward protruding portion 221*a* of second end part 170*b* colliding with forward vertical plate 23*a* of forward hook portion 22*a*. Likewise, it is possible to reduce the force exerted by rearward protruding portion 221*b* of second end part 170*b* colliding with rearward vertical plate 23*b* of rearward hook portion 22*b*. As a result, it is possible to reduce the load to fall prevention member 170 and second mount portion 20.

Fourth Exemplary Embodiment

Figure 12:
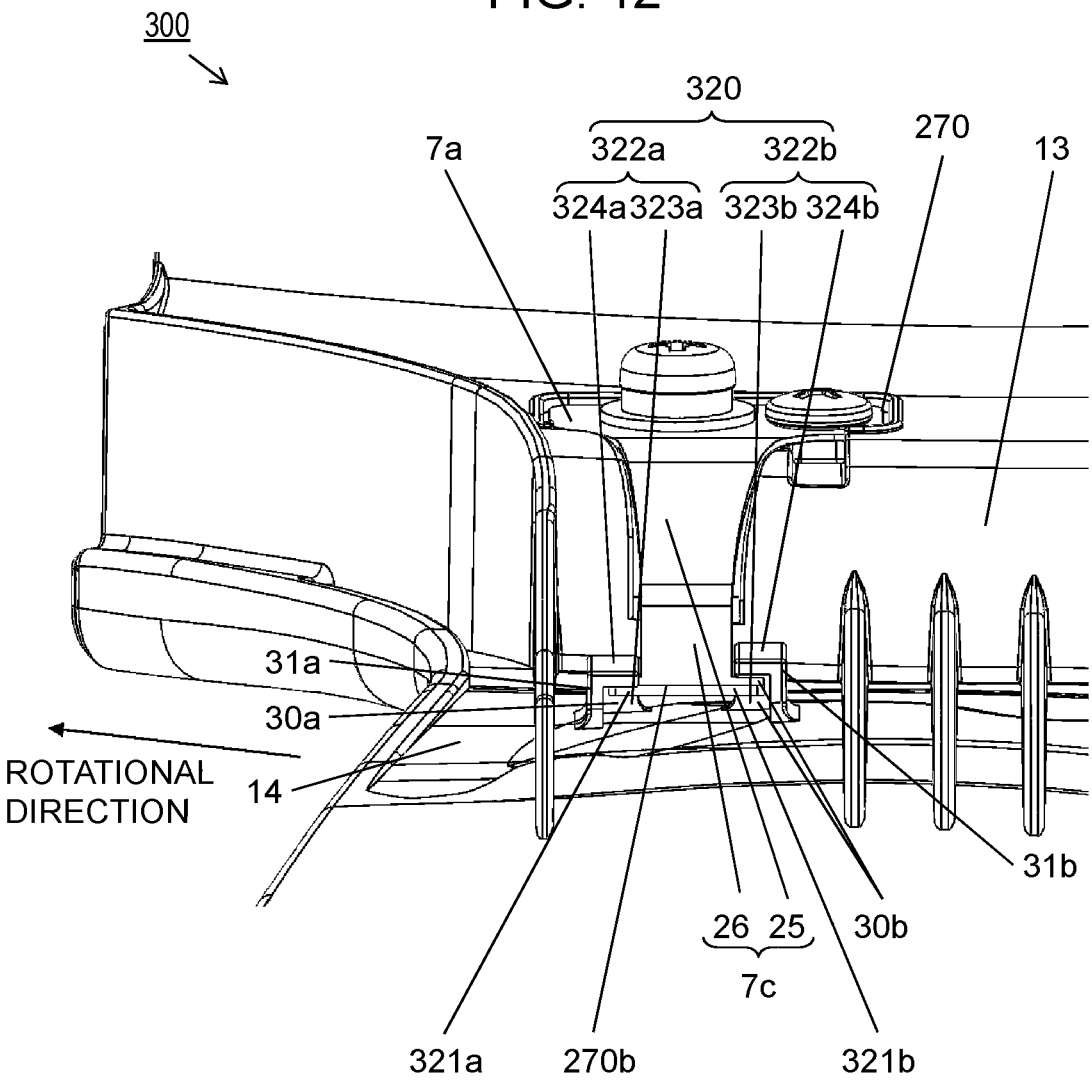
FIG. 12 is a partially enlarged view of a ceiling fan according to a fourth exemplary embodiment, illustrating a portion where a fall prevention member is mounted.

FIG. 12 is a partially enlarged view of ceiling fan 300 according to a fourth exemplary embodiment of the present disclosure, which illustrates a portion where fall prevention member 270 is mounted. The same elements as those in the first exemplary embodiment are designated by the same reference characters, and the description thereof will not be repeated.

As illustrated in FIG. 12, a difference from the first exemplary embodiment is the configuration of second end part 270*b* of fall prevention member 270 and second mount portion 320.

More specifically, until fan blade 6 breaks, the upper surface of forward protruding portion 321*a* is in contact with forward horizontal plate 324*a* of forward hook portion 322*a*, and clearance gap 30*a* is provided between the lower surface of forward protruding portion 321*a* and the upper surface of fan blade 6. Also, clearance gap 30*b* is provided between rearward protruding portion 321*a* and rearward horizontal plate 324*b* of rearward hook portion 322*b* and between rearward protruding portion 321*a* and the upper surface of fan blade 6.

When fan blade 6 breaks, a portion of blade body 14 that is forward with respect to the rotational direction of blade body 14 and a portion of blade body 14 that is rearward with respect to the rotational direction of blade body 14 pivot vertically and tilt in a widthwise direction of blade body 14 because of clearance gap 30*a* and clearance gap 30*b* with blade body 14 being connected to securing portion 12 of support part 5 by fall prevention member 270 and being pulled toward the tip end of blade body 14. At this time, the end of forward protruding portion 321*a* of fall prevention member 270 that is located closer to the root end of fan blade 6 is kept hooked onto the second surface of forward vertical plate 323*a*, and the end of rearward protruding portion 321*b* that is located closer to the root end of fan blade 6 is kept hooked onto the second surface of rearward vertical plate 323*b*. Furthermore, because fall prevention member 270 is deformed, a portion of blade body 14 that is forward with respect to the rotational direction of blade body 14 and a portion of blade body 14 that is rearward with respect to the rotational direction of blade body 14 pivot vertically and tilt in a widthwise direction of blade body 14.

In addition, when fan blade 6 breaks, only the upper surface of forward protruding portion 321*a* rubs against the lower surface of forward horizontal plate 324*a* of forward hook portion 322*a*. This means that when fan blade 6 breaks, blade body 14 is centered on forward horizontal plate 324*a* of forward hook portion 322*a*, which rubs against the upper surface of forward protruding portion 321*a*, so the center of gravity of blade body 14 more easily shifts to the straight line connecting rotational axis 3*a* of DC motor 3 and second end part 270*b* of fall prevention member 270. Therefore, blade body 14 retained by fall prevention member 270 can tilt more easily. As a result, when fan blade 6 breaks, blade body 14 can tilt more easily and can provide resistance to rotation of DC motor 3 more quickly, so rotation of fan blade 6 can be stopped more quickly.

Fifth Exemplary Embodiment

Figure 13:
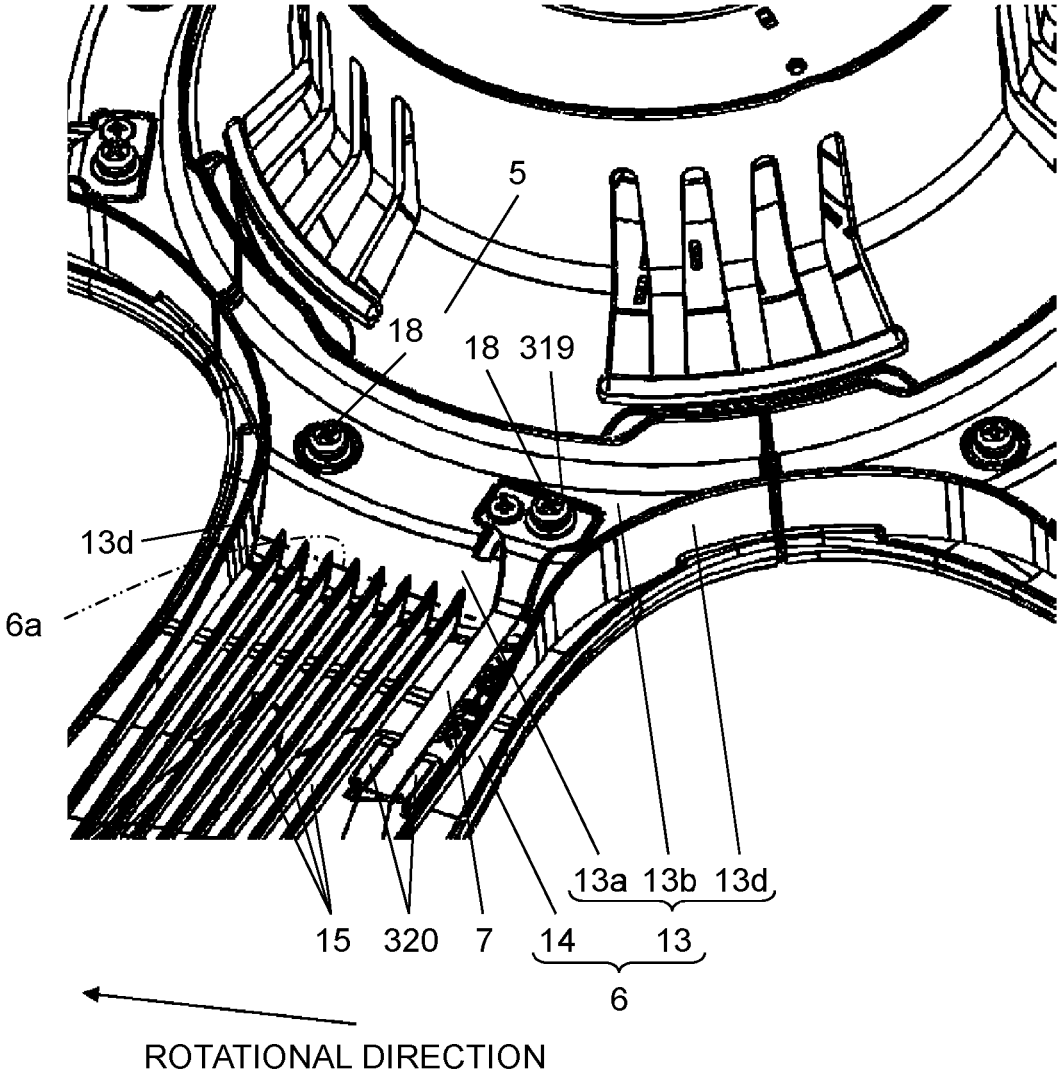
FIG. 13 is a partially enlarged view of a ceiling fan according to a fifth exemplary embodiment, illustrating a portion where a fan blade is mounted to a support part.
Figure 14:
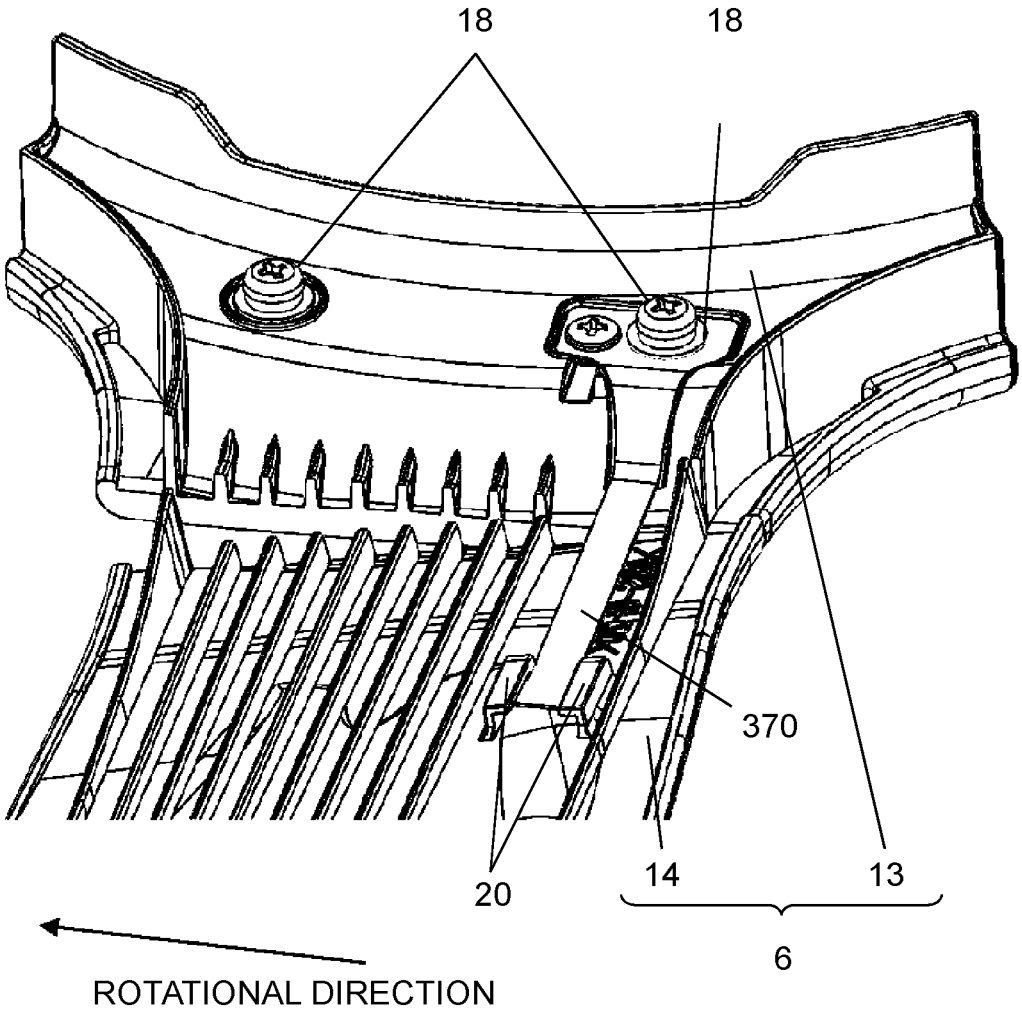
FIG. 14 is a view illustrating a state of the ceiling fan in which the fan blade is retained by a fall prevention member when the portion of the fan blade mounted to the support part is broken.

FIG. 13 is a partially enlarged view of ceiling fan 400 according to a fifth exemplary embodiment of the present disclosure, illustrating a portion where fan blade 6 is mounted to support part 5. FIG. 14 is a view illustrating a state of ceiling fan 400 according to the fifth exemplary embodiment of the present disclosure, in which fan blade 6 is retained by fall prevention member 370 when the portion of fan blade 6 mounted to support part 5 is broken. The same elements as those in the first exemplary embodiment are designated by the same reference characters, and the description thereof will not be repeated.

As illustrated in FIGS. 13 and 14, a difference from the first exemplary embodiment is the arrangement of first mount portion 319 and second mount portion 320. More specifically, first mount portion 319 and second mount portion 320 are disposed in a widthwise rearward portion of blade body 14 with respect to the rotational direction of fan blade 6, and center of gravity 6*b* of the fan blade in blade body 14 that has broken off at stress concentrated location 6*a* is located at a widthwise central portion of blade body 14. First mount portion 319 is disposed at a position higher than second mount portion 320. When stress concentrated location 6*a* breaks, an end portion of blade body 14 that is forward with respect to the rotational direction of fan blade 6 shifts further downward than an end portion of blade body 14 that is rearward with respect to the rotational direction of fan blade 6. Thereby, center of gravity 6*b* of fan blade 6 shifts to the straight line connecting rotational axis 3*a* of DC motor 3 and second mount portion 320. The reason is believed to be that, due to the centrifugal force, center of gravity 6*b* of the fan blade that is in blade body 14 broken at stress concentrated location 6*a* moves to the straight line connecting rotational axis 3*a* of DC motor 3 and second mount portion 320 provided on blade body 14 while moving to the height of first mount portion 319 or to a higher position than the height of first mount portion 319.

Accordingly, when fan blade 6 breaks, center of gravity 6*b* of fan blade 6 that is broken and retained by fall prevention member 370 (i.e., the portion of fan blade 6 that is in blade body 14 that has broken off at stress concentrated location 6*a*) moves onto straight line A, which connects rotational axis 3*a* of DC motor 3 and second mount portion 320 provided on blade body 14. Therefore, the portion of the fan blade 6 that is broken and retained by fall prevention member 370 tilts more easily, and provides resistance to rotation of DC motor 3 more easily.

Modified Example

Figure 15:
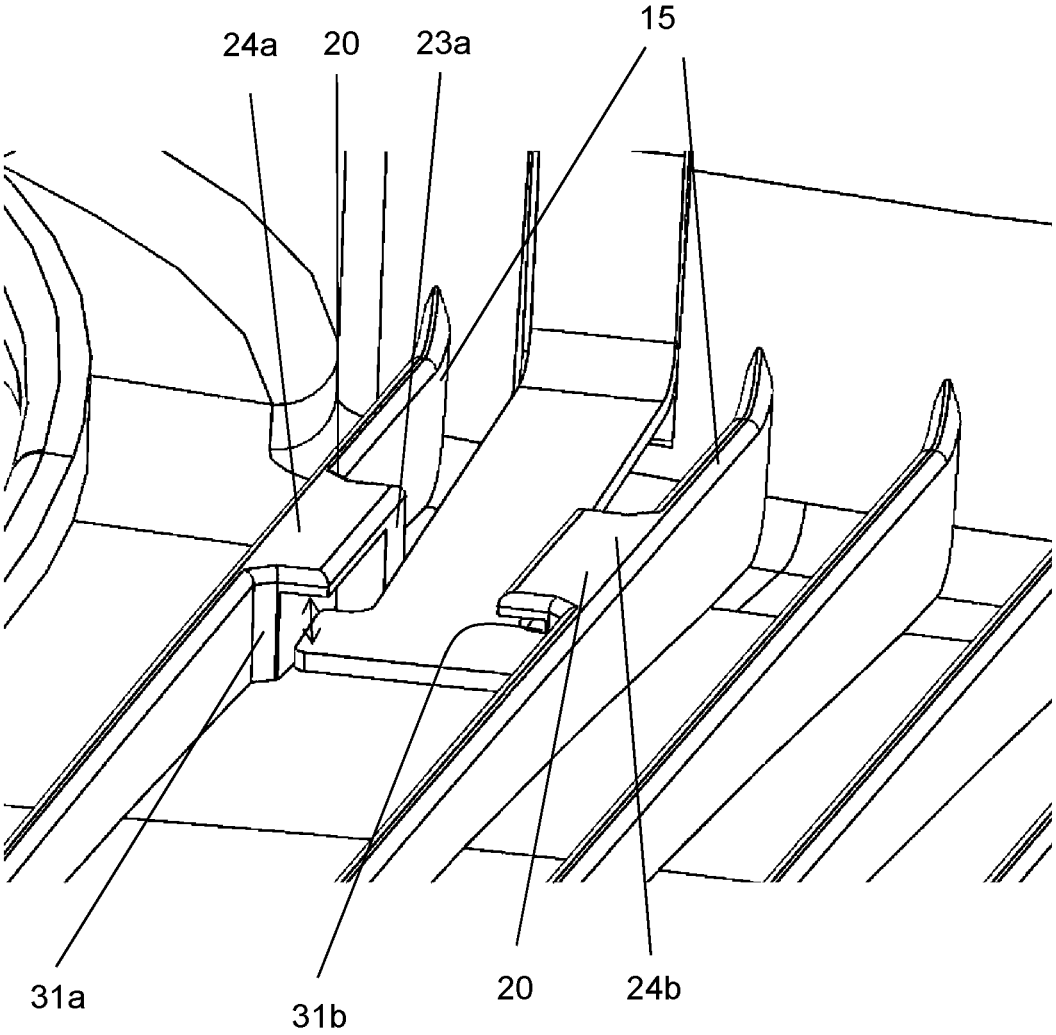
FIG. 15 is a partially enlarged view of a ceiling fan according to a modified example, illustrating a portion where a fall prevention member is mounted.

FIG. 15 is a partially enlarged view of a ceiling fan according to a modified example, illustrating a portion where a fall prevention member is mounted. The foregoing exemplary embodiments show that forward reinforcement plate 31*a* and rearward reinforcement plate 31*b* are provided independently from each other. However, it is also possible that forward reinforcement plate 31*a* and rearward reinforcement plate 31*b* may be provided integrally with protruding ribs 15, as illustrated in FIG. 15.

INDUSTRIAL APPLICABILITY

The present invention is useful for ceiling fans for home or office use.

REFERENCE SIGNS LIST

1, 100, 200, 300, 400 ceiling fan
2 connecting part
2*a* joint portion
3 DC motor
3*a* rotational axis
4 motor cover
5 support part
6 fan blade
6*a* stress concentrated location
6*b* center of gravity
7, 70, 170, 270, 370 fall prevention member
7*a* first end part
7*b*, 70*b*, 170*b*, 270*b* second end part
7*c*, 70*c* connecting plate part
8 suspension part
9 pipe part
10 ceiling
11 outer shell
12 securing portion
13 root portion
13*a* side plate
13*b* upper plate
13*c* lower plate
13*d*, 13*e* connecting plate
14 blade body

15 protruding rib
16 fastening hole
17 hole
18 fastening member
19, 319 first mount portion
20, 320 second mount portion
21*a*, 121*a*, 221*a*, 321*a* forward protruding portion
21*b*, 121*b*, 221*b*, 321*b* rearward protruding portion
22*a*, 322*a* forward hook portion
22*b*, 322*b* rearward hook portion
23*a*, 323*a* forward vertical plate
23*b*, 323*b* rearward vertical plate
24*a*, 324*a* forward horizontal plate
24*b*, 324*b* rearward horizontal plate
25, 125 first connecting plate portion
26, 126 second connecting plate portion
27*a*, 27*b*, 28*a*, 28*b*, 29*a*, 29*b*, 30*a*, 30*b*, 37*a*, 37*b* clearance gap
31*a* forward reinforcement plate
31*b* rearward reinforcement plate
40 controller
50 measurer

What is claimed is:

1. A ceiling fan comprising:

a DC motor;

a support part rotated by the DC motor;

a fan blade attached to the support part;

a fall prevention member engaged with the fan blade and the support part;

a controller for controlling electric energization to the DC motor; and a measurer for measuring at least one of a value of current flowing to the DC motor and a rotation speed of the DC motor, wherein:

the fan blade includes:

a blade body blowing air; and a root portion secured to the support part, the fall prevention member includes:

a first end part;

a connecting plate part extending along a longitudinal axis of the fan blade from the first end part; and a second end part disposed at a distal end of the connecting plate part, the first end part is attached to a first mount portion disposed in the support part, the second end part is attached to a second mount portion disposed on the blade body, the controller controls the electric energization to the DC motor to cause the fan blade to stop rotating when the fan blade breaks and the blade body is thereby retained to the support part in a tilted position by the fall prevention member such that the tilted blade body thereby causes the at least one of the value of current or the rotation speed measured by the measurer to change from a predetermined value, the fan blade includes a stress concentrated location on which stress concentrates when the fan blade rotates, the stress concentrated location located between the first mount portion and the second mount portion, the second mount portion is disposed on the blade body at such a location that a straight line connecting the second mount portion and a rotational axis of the DC motor intersects a straight line connecting the second mount portion and a center of gravity of the fan blade that is in the blade body when the blade body has broken at the stress concentrated location, the blade body is in an elongated plate shape extending laterally from the root portion, the root portion includes:

a side plate protruding upward from an upper surface of the blade body and extending along a widthwise axis of the blade body;

an upper plate extending from an upper portion of the side plate toward a center of rotation of the fan blade; and a lower plate extending from a lower portion of the side plate toward the center of rotation of the fan blade, a plurality of connecting plates each protruding upward from the upper surface of the blade body and connecting an end of the upper plate and an end of the lower plate, the upper plate is secured to an upper surface of the support part, and the blade body includes a plurality of reinforcing portions protruding upward from the upper surface of the blade body and extending from the side plate toward a tip end of the blade body.

2. The ceiling fan according to claim 1, wherein a clearance gap is provided between (i) the support part and (ii) the side plate, one of the plurality of connecting plates, and the lower plate.

* * * * *